US005513554A

United States Patent [19]

Paulsson

[11] Patent Number: 5,513,554

[45] Date of Patent: May 7, 1996

[54] LOCKABLE TELESCOPIC DEVICE AND USE OF THE SAME

[75] Inventor: Roger Paulsson, Koskullskulle, Sweden

[73] Assignee: Roger Paulusson AB, Gällivare, Sweden

[21] Appl. No.: 369,785

[22] Filed: Jan. 6, 1995

Related U.S. Application Data

[63] Continuation-in-part of PCT/SE93/00588, Jun. 29, 1993

[30] Foreign Application Priority Data

Jul. 8, 1992 [SE] Sweden ..... 9202115

[51] Int. Cl.[6] ..... F15B 15/26

[52] U.S. Cl. ..... 92/18; 92/20

[58] Field of Search ..... 92/17, 23, 18, 92/20

[56] References Cited

U.S. PATENT DOCUMENTS

| | | | |
|---|---|---|---|
| 3,095,825 | 7/1963 | Sandberg et al. . | |
| 3,150,569 | 9/1964 | Attermeyer . | |
| 3,668,977 | 6/1972 | Beidler | 92/17 |
| 4,240,334 | 12/1980 | Crossen | 92/17 |

FOREIGN PATENT DOCUMENTS

| | | | |
|---|---|---|---|
| 1119615 | 12/1961 | Germany . | |
| 1159152 | 12/1963 | Germany . | |
| 0721566 | 3/1980 | U.S.S.R. | 92/17 |
| 0496038 | 10/1938 | United Kingdom | 92/18 |

*Primary Examiner*—Thomas E. Denion
*Attorney, Agent, or Firm*—Nils H. Ljungman & Associates

[57] ABSTRACT

The invention relates to a lockable telescopic device (1) which includes a cylindrical tube (10) and a piston rod (3). The piston rod (3) includes an expandable locking device (60) which, when active, forcibly abuts a part of the inner wall of the tube (10). The expandable locking device (60) includes two sleeves (61, 62) which accompany movement of the piston rod (3) in the longitudinal direction of the device (1). The piston rod (3) and the tube (10) are locked against relative movement by rotating the sleeves (61, 62) relative to one another with the aid of a lever (51) mounted on the piston rod. The invention also relates to the use of the lockable telescopic device in conjunction with so-called engine shelves.

20 Claims, 6 Drawing Sheets

LOCKABLE TELESCOPIC DEVICE AND USE OF THE SAME

This application is a Continuation-In-Part Application of International Application No. PCT/SE93/00588, filed on Jun. 29, 1993, and having International Publication No. WO 94/01683 published on Jan. 20, 1994 with the United States of America as a designated state. International Application No. PCT/SE93/00588, was pending as of the filing date of this application.

BACKGROUND OF THE INVENTION

The present invention relates to a lockable telescopic device according to the preamble of Claim 1 and to the use of the lockable telescopic device.

There are many-situations in which there is a need for a simple and reliable telescopic device which will enable objects and apparatus of different kinds to be adjusted to different positions and firmly locked therein.

SUMMARY OF THE INVENTION

The object of the present invention is to provide an attractive device of the aforesaid kind. This object is achieved with a lockable, telescopic device that has the features set forth in the following Claims.

One advantage afforded by the invention, among other advantages, is that the device can be readily adjusted to different lengths and locked in its adjusted position, and can be used in extremely difficult environments.

BRIEF DESCRIPTION OF THE DRAWINGS

The invention will now be described in more detail with reference to an exemplifying embodiment thereof and also with reference to the accompanying drawings, in which.

DETAILED DESCRIPTION OF THE INVENTION

Figure 1:
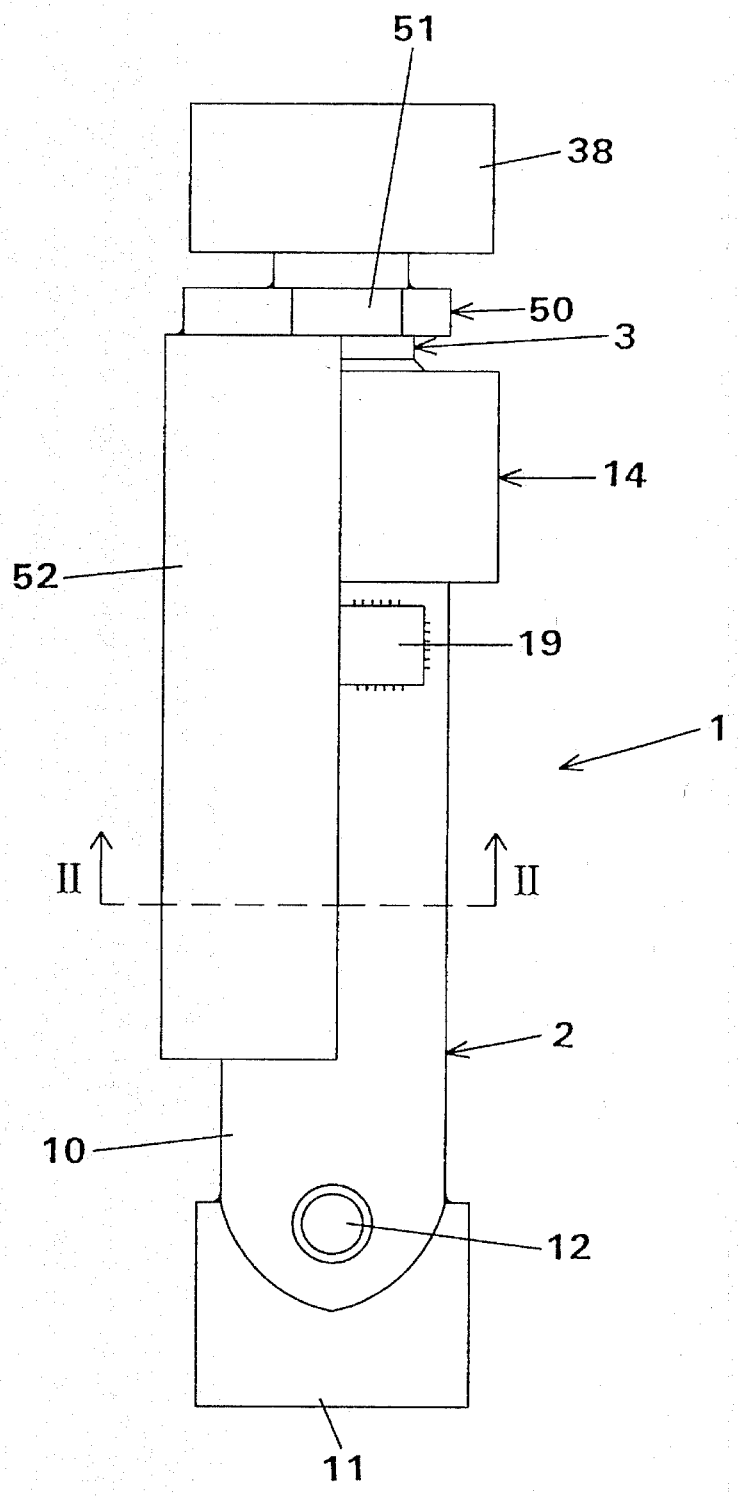
FIG. 1 is a longitudinal view of the inventive device.

The illustrated inventive telescopic device 1 comprises a cylinder 2 and a piston rod 3.

The cylinder 2 is constructed around a cylindrical tube 10 which is sealed at its rearward end by an attachment in the form of a sleeve 11 welded to said end. Also mounted on the rearward end of the cylinder 2 is a nipple 12 for connection to a hydraulic system, when used. As will be seen from FIG. 2, the tube 10 is provided internally with a keyway 13 which extends along at least a major part of the length of the cylinder 2.

Fitted to the forward end of the cylinder 2 is a so-called cylinder cover 14 which is screwed to the tube 10 by means of a screw joint 15. The cylinder cover 14 includes a central opening and carries three ring seals in the form of a stripper or wiper 16, a U-cuff 17 and an O-ring 18. A stop shoulder 19 is mounted on the outside of the tube 10.

The piston rod 3 comprises a circular rod 30 having a centre part 31 whose diameter is adapted to the internal diameter of the tube 10 and the cover 14. The rearward end of the rod 30 is provided with a shoulder 32 whose diameter is smaller than the diameter of the centre part 31. The shoulder 32 is provided with a keyway 33.

The forward and free end of the rod 30 is provided with a shoulder 34 whose diameter is smaller than the diameter of the centre part 31 of the rod 30. The shoulder 34 carries a so-called toggle-link bearing 35 having an outer ring 36 which is fixed with the aid of a locking ring 37, for instance, to an attachment in the form of a sleeve 38. The toggle link bearing 35 is fixed to the rod 30 by means of an end-plate 39 screwed to the forward end of the rod 30.

Fitted to the rod 30 is a rotary device 50 by means of which the piston rod 3 can be rotated relative to the cylinder 2. The rotary device 50 includes an operating lever 51 which is welded to the rod 30. The lever 51 carries stop means 52, the construction of which will be seen from FIGS. 1 and 2.

The shoulder 32 on the rod 30 carries the inventive locking device 60. The locking device 60 includes an eccentric sleeve 61 and a slotted outer sleeve 62. The internal shape of the outer sleeve 62 is adapted to the outer shape of the eccentric sleeve 61 and the outer shape of the outer sleeve 62 is circular and adapted to the cylindrical tube 10. The eccentric sleeve 61 has a key 63 which coacts with the keyway 33 in the shoulder 32, so as to cause the eccentric sleeve 61 to accompany rotary movement of the piston rod 3.

Figure 4:
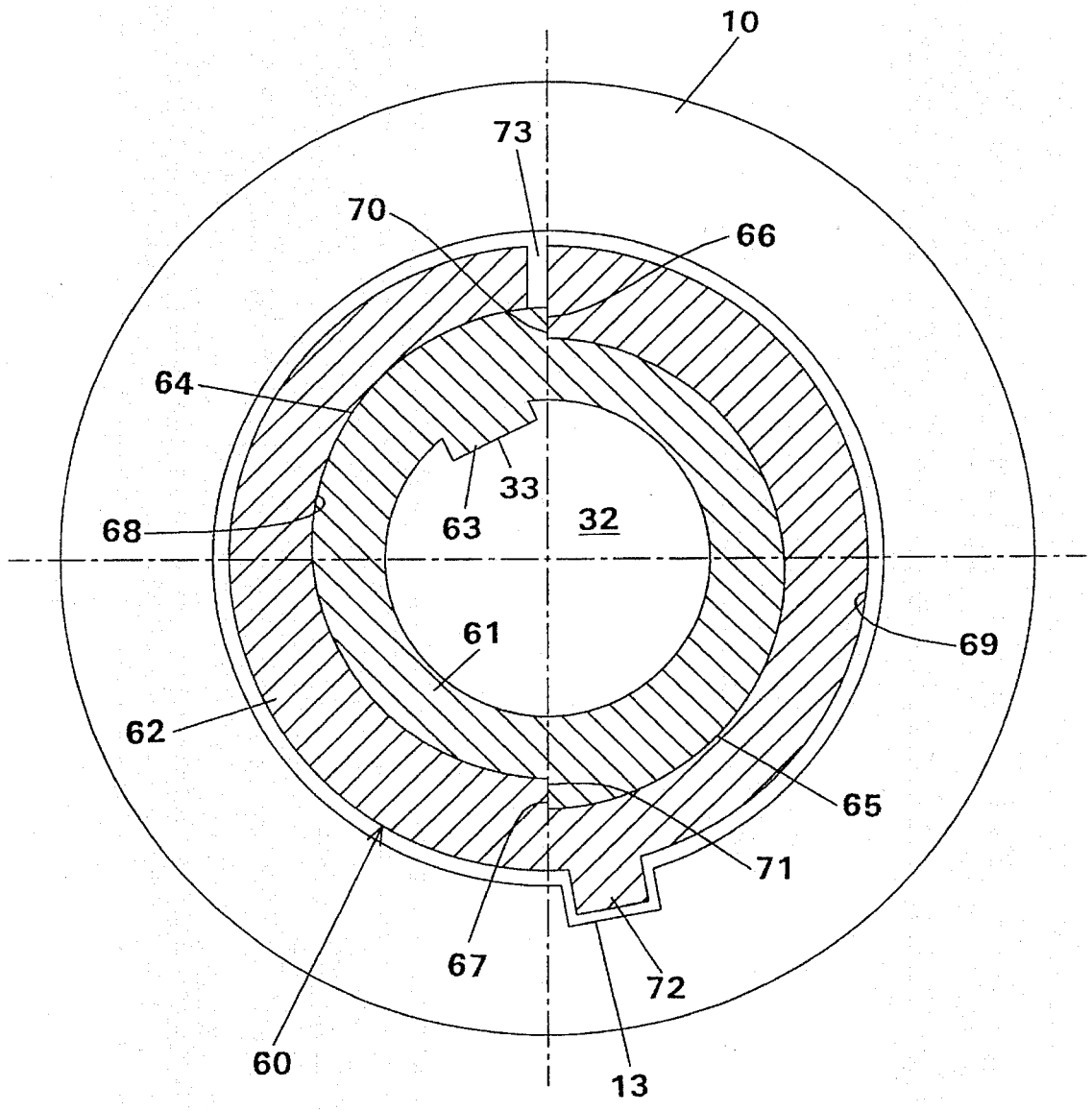
FIG. 4 is a cross-sectional view in larger scale taken on the line IV—IV in FIG. 3.
Figure 4A:
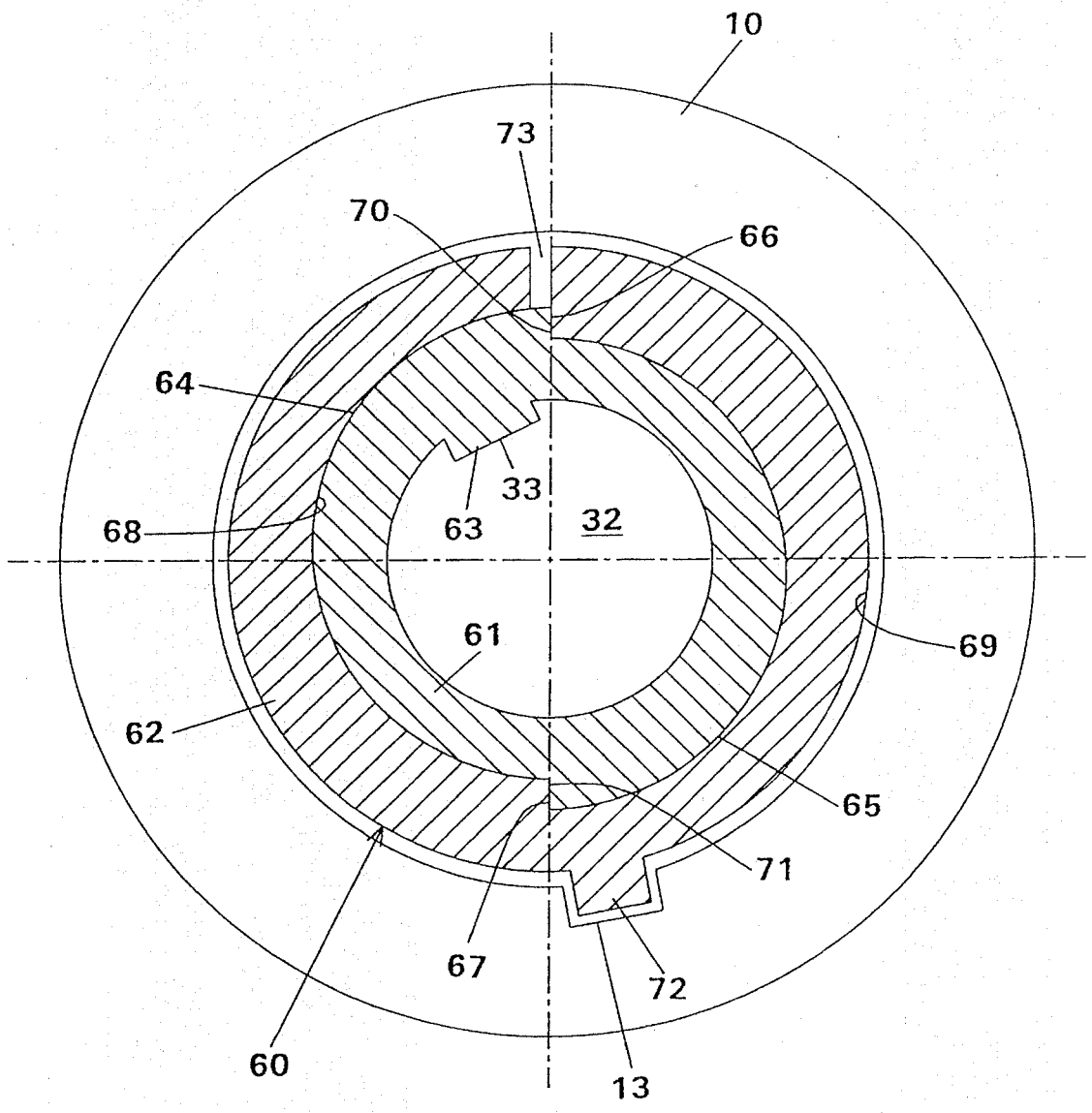
FIG. 4*a* is a sectional view taken on the line IV—IV FIG. 3.

As a more detailed description of a locking device according to one embodiment of the present invention, as will be seen from FIG. 4*a*, the eccentric, inner sleeve 61 can preferably include an outer surface 64 which essentially gradually decreases in radius in a counter-clockwise direction, from an uppermost, or "twelve o'clock" position with respect to FIG. 4*a*. At a lowermost, or "six o'clock" position, with respect to FIG. 4*a*, the eccentric, inner sleeve 61 preferably includes a transition edge or surface 67 which provides an abrupt increase in radius to outer surface 65. Thence, the radius of surface 65 of sleeve 61 preferably gradually decreases in a counter-clockwise direction, from an uppermost, or "twelve o'clock" position as shown in FIG. 4*a*. Accordingly, the outer sleeve 62 preferably includes an inner surface 70 which gradually increases in radius in a counter-clockwise direction, from an uppermost, or "twelve o'clock" position with respect to FIG. 4*a*. At a lowermost, or "six o'clock" position, the outer sleeve 62 preferably includes a transition edge or surface 71 which abruptly decreases in radius to inner surface 69 in a counter-clockwise direction. Thence, the radius of surface 69 of sleeve 62 preferably gradually increases in a counter-clockwise direction. Thus the sleeves 61 and 62 preferably interface essentially thereby with one another.

The inner sleeve 61 and the outer sleeve 62 preferably form, collectively, an interconnected circular sleeve in which the diameter of outer sleeve expands upon rotation of inner sleeve 61 resulting in the locking position of the telescopic device 1. In the expanded state of sleeve 62, the diameter of sleeve 62 preferably increases so as to firmly contact the internal walls of tube 10 which in turn grip the outer surface of sleeve 62.

With this arrangement of the inner sleeve 61 and the outer sleeve 62, turning of the lever 51 will essentially cause the eccentric, inner sleeve 61 to rotate thereby causing the outer sleeve 62 to radially outwardly expand and radially lock into a frictional engagement with the inner walls of the tube 10.

This can represent a significant advantage in that, as opposed to known devices, there is essentially a continuous frictional engagement along the entire internal surface of the tube 10. The resulting locking or gripping action of the constituent components can essentially form a firm grip and distribute the gripping force around up to substantially the entire circumference of the internal surface of tube 10, making possible a much larger surface of contact than in prior art devices.

A further advantage of the present invention, according to at least one preferred embodiment, lies in its durability, which essentially comes from the continuous radially outward expansion of sleeve 62 along the inner circumference of the tube 10. Unlike known devices, which may have comprised only a limited number of small, circumferentially spaced contacts, the lockable telescopic device bears the advantage of continuous contact between the outer sleeve 62 and internal surface of tube 10, thus compensating for any wear at any point over long periods of use.

As shown in FIG. 4*a*, a particular advantage of the lockable telescopic device 1, according to at least one preferred embodiment, lies in its capability to essentially compensate for wear due to long term use. The wear is essentially compensated for by the large surface of contact as well as the capability of the inner sleeve 61 of the telescopic device 1 to rotate farther counter-clockwise after long term use, thereby, placing adequate force on the outer sleeve 62 to radially outwardly expand and firmly contact the inner walls of the tube 10.

The eccentric sleeve 61 and the outer sleeve 62 are fixed axially in relation to the shoulder 32 on the piston rod, by means of an end-plate 40 screwed firmly to the piston rod 3.

Figure 2:
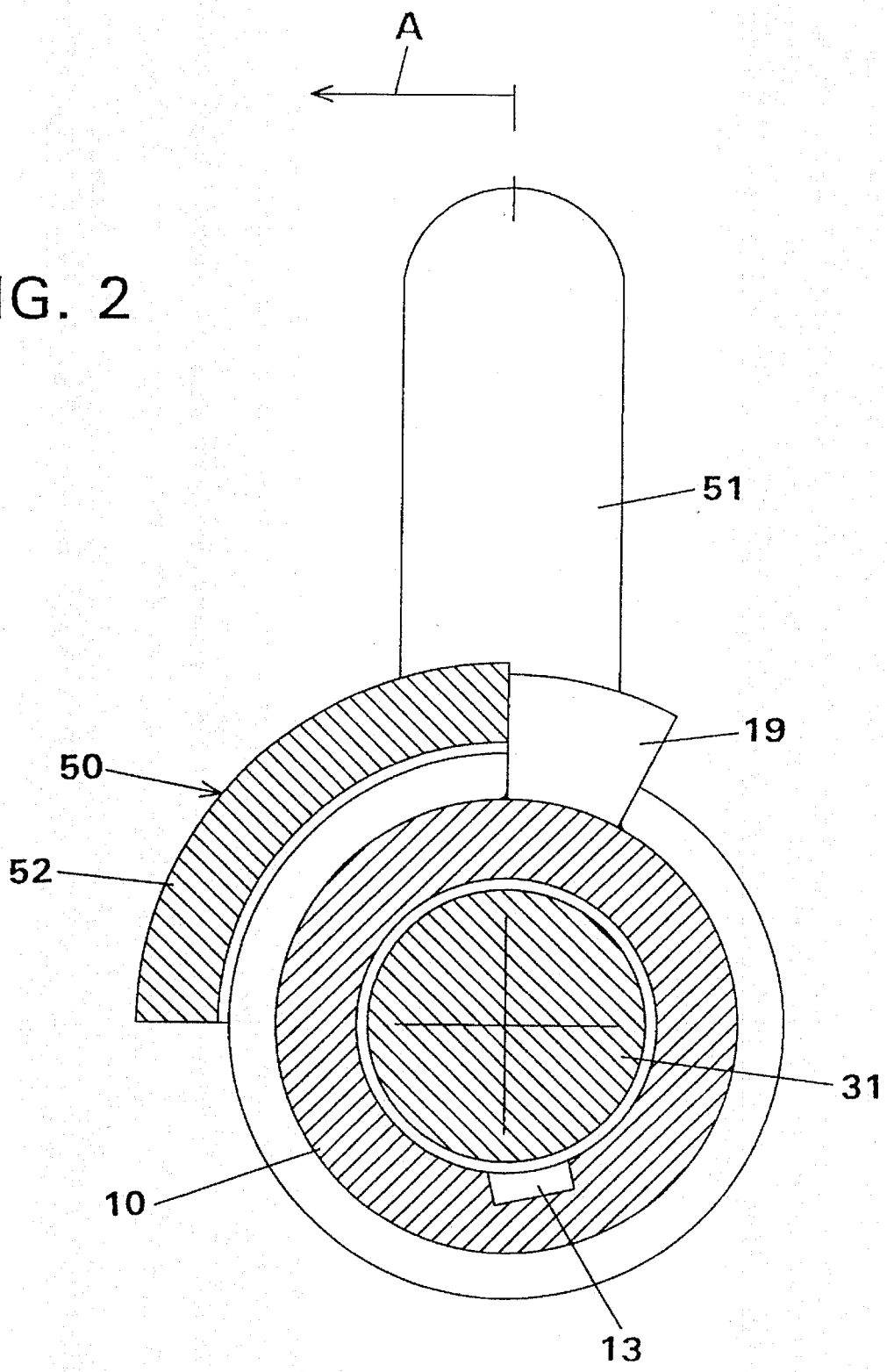
FIG. 2 is a cross-sectional view in larger scale taken on the line II—II in FIG. 1.
Figure 3:
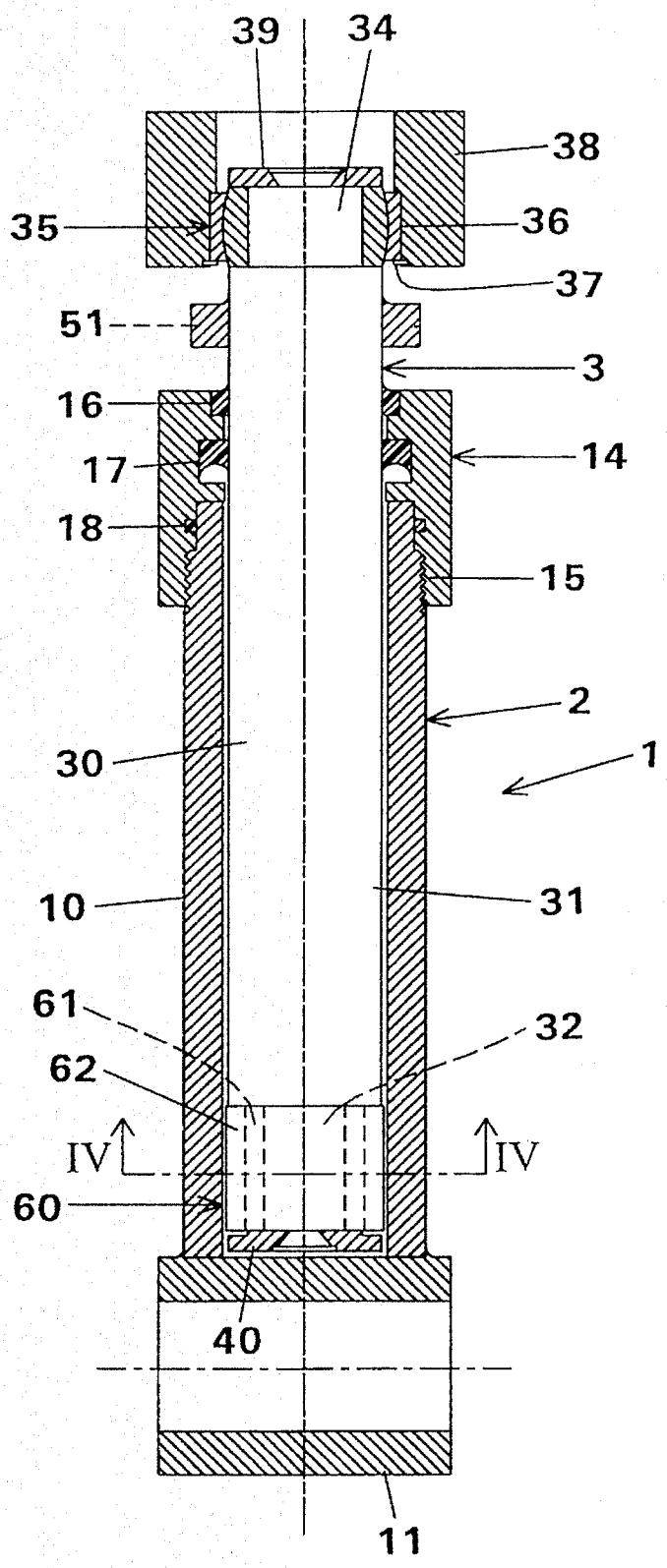
FIG. 3 is a longitudinal sectioned view of the device.

As will be seen from FIG. 4, the eccentric sleeve 61 includes on its peripheral surface two eccentric parts 64, 65 which are defined by two transition edges 66, 67. The outer sleeve 62 includes internally two eccentric parts 68, 69 which coincide with the eccentric parts 64, 65 of the eccentric sleeve 61, these eccentric parts 68, 69 also being defined by two transition edges 70, 71. The outer sleeve 62 is provided with a slot 73 which enables the outer sleeve to expand. In the relative position of rotation of the sleeve 61 and 62 shown in FIG. 4, the transition edges are in mutual abutment and the slot 73 has a minimum width. In this operational state of the arrangement, the piston rod 3 can move relative to the cylinder 2 since the sleeve 62 will then have an outer diameter with which no frictional engagement occurs between the tube 10 and the sleeve 62. In this free-state of the locking device, the operating lever 51 is in a position in which the stop shoulders 19 and 52 are in mutual contact, as shown in FIGS. 1 and 2.

The outer sleeve 62 has an external key 72 which coacts with the keyway 13 in the tube 10. When adjusting the length of the telescopic device by means of the piston rod 3, the key 72 will slide along the keyway 13.

The inventive locking device 60 is used and operates in the following manner:

It is assumed that the aforedescribed telescopic device 1 is secured, via its attachment points 11 and 38, to an object whose position is to be adjusted and which is to be locked in its adjusted position. It is also assumed that the lever 51 is located in the free position shown in FIGS. 1 and 2 and that the locking device 60 is therewith inactive.

A manually operated hydraulic pump is connected temporarily to the nipple 12 and the telescopic device 1 is then adjusted to a desired length with the aid of the pump, since hydraulic fluid delivered by the pump will act between the cylinder 2 and the piston rod 3. When the device 1 has been adjusted to the length desired, the piston rod 3 is locked relative to the cylinder 2 by turning the lever 51 in the direction of arrow A. The eccentric sleeve 61 accompanies this movement of the lever and thus rotates relative to the outer sleeve 62. As a result of the earlier described eccentricity, this relative rotation of the sleeves 61 and 62 will cause the outer sleeve 62 to expand into pressure abutment with the inner surface of the tube 10. The slot 73 widens as the outer sleeve 62 expands. The pump can be disconnected from the device 1, when the lever 51 has been rotated to achieve effective locking between the piston rod 3 and the cylinder 2. The telescopic device 1 can be easily adjusted to a new length, by again connecting a hydraulic pump to said nipple and releasing the eccentric locking action by rotating the lever 51 to the free position/end position shown in FIGS. 1 and 2, whereafter the piston rod is moved to a new, desired position and the lever 51 is turned in the direction of arrow A until the device is firmly locked, and so on.

One particularly interesting field of use for the inventive device 1 is found in so-called engine shelves, where the device 1 can replace conventional adjusting screws used to adjust a pivotally mounted engine shelf to an appropriate angle in conjunction with adjusting the tension of V-belts and the like.

Figure 5:
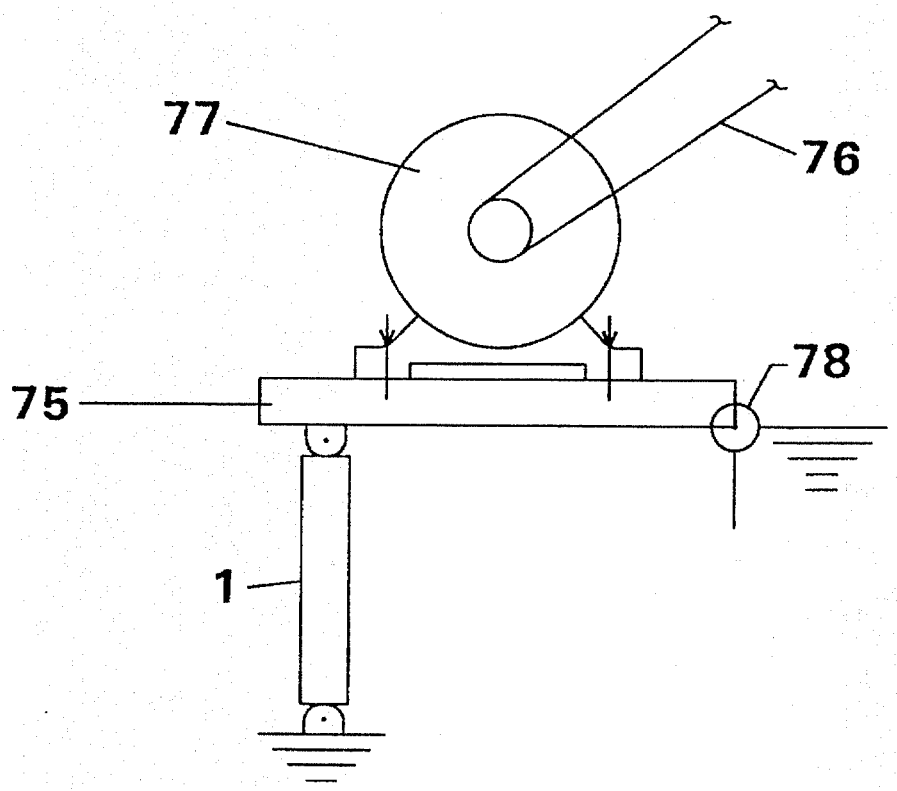
FIG. 5 is an example of a particular use of the invention device with an engine shelf.

As shown in FIG. 5, the lockable telescopic device 1 replaces conventional adjusting screws for the adjustment of the angle of an engine shelf 75 in conjunction with adjusting the tension of V-belts 76 and the like of an electric motor 77.

It will be seen, however, that the inventive device can be used in many different areas. It will also be understood that the device is not always dependent on the use of a hydraulic pump when adjusting the length of the inventive device.

It will also be understood that the inventive device is not restricted to the illustrated and described embodiments thereof and that modifications can be made. For instance, the attachments 11 and 38 may be different to that described and illustrated.

The stop shoulders 19 and 52 are mainly intended to protect the keys 63 and 72 and the transition edges 66, 67 and 70, 71, and are not therefore necessary features of the manner in which the inventive device functions.

It will also be understood that the eccentric sleeve 61 and the outer sleeve 62 can be modified within certain limits. The keys 63 and 72 may, of course, be separate parts or may be exchanged for other components of equivalent function.

According to one embodiment of the invention, the eccentric sleeve 61 may be an integral part of the piston rod 3, i.e. formed integrally with the piston rod 3.

Types of telescopic devices in which the present invention may be utilized may be or are disclosed in the following U.S. Pat. Nos. 3,095,825 to Sandberg et al. on Jul. 2, 1963; 3,150,569 to Attermeyer on Sep. 29, 1964; 4,793,646 to Northeast Marine, Inc. on Dec. 7, 1988; 4,840,340 to GH Trading/AB on Jun. 20, 1989; and the following patent from The Federal Republic of Germany: No. 1,119,615 (VEB LANDMASCHINENBAU"ROTES BANNER) on Dec. 14, 1961.

The corresponding PCT Patent Application No. PCT/SE 93/00588, filed on Jun. 29, 1993 and having International Publication No. WO 94/01683, published on Jan. 20, 1994, is incorporated by reference as if set forth in its entirety herein.

Types of devices which may used in accordance with engine shelves may be or are disclosed by the following U.S.

Pat Nos. 4,893,661 to C. R. Onsrud on Jan. 16, 1990 and 5,030,173 to Bryant on Jul. 9, 1991.

One feature of the invention resides broadly in the lockable telescopic device comprising a cylindrical tube 10 and piston rod 3, wherein the piston rod 3 includes an expandable locking device 60 which, in its active position, is in pressure abutment with a part of the inner wall of the tube 10, characterized in that the expandable locking device 60 includes an eccentric sleeve 61 which is non-rotatable in relation to the piston rod 3 or which is integral with the piston rod 3; and in that the locking device 60 includes an outer sleeve 62 which is slidable and non-rotatable in relation to the tube 10.

Another feature of the invention resides broadly in the device, characterized in that the outer sleeve 62 is provided with at least one slot 73 so as to enable the sleeve to expand.

Yet another feature of the invention resides broadly in the device, characterized in that the eccentric sleeve 61 and the outer sleeve 62 are fixed axially to the piston rod 3 such as to accompany movement of the piston rod 3.

Still another feature of the invention resides broadly in the device, characterized in that the peripheral surface of the eccentric parts 64 and 65 which are terminated by transition edges 66 and 67.

Another feature of the invention resides broadly in the device, characterized in that the outer sleeve 62 has a center hole which includes two eccentric parts 68 and 69 which are terminated by transition edges 70 and 71; and in that the outer sleeve 62 has a circular peripheral surface.

Yet another feature of the invention resides broadly in the device, characterized in that the piston rod 3 is provided with an operating device 51 which enables the piston rod 3 to be rotated relative to the tube 10.

Further, another feature of the invention resides broadly in the device, characterized in that the tube 10 has a working fluid connection point 12.

Yet another further feature of the invention resides broadly in the device, characterized in that the tube 10 and the piston rod 3 are provided with attachment means 11 and 38, respectively, for connecting the device to an object.

Still yet another further feature of the invention resides broadly in the use of a lockable telescopic device, characterized in that the device is used to adjust the angular position of a so-called engine shelf in conjunction with adjusting belt tension and like tasks.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

The invention is thus not restricted to the described and illustrated embodiments thereof, since changes and modifications are conceivable within the scope of the following Claims.

I claim:

1. A lockable telescopic device for positioning at least one movable object relative to at least one other object, said lockable telescopic device comprising:

a cylindrical tube;

said cylindrical tube having an inner circumference and an outer circumference;

said cylindrical tube having a first end and a second end;

said first end of said cylindrical tube comprising first attachment means for attaching to one of:
said at least one movable object, and
said at least one other object;

a substantial portion of said cylindrical tube being disposed between said first end and said second end of said cylindrical tube;

a piston rod;

said piston rod being slidably disposed through said first end of said cylindrical tube;

said piston rod having a longitudinal axis;

said cylindrical tube having a longitudinal axis;

said longitudinal axis of said cylindrical tube defining an axial direction parallel to said longitudinal axis of said piston rod;

said piston rod having a first end disposed within said cylindrical tube;

said piston rod having a second end extending from said cylindrical tube;

said second end of said piston rod comprising second attachment means for attaching to the other of:
said at least one movable object, and
said at least one other object;

said first attachment means and said second attachment means defining therebetween, a length of said lockable telescopic device;

said piston rod for slidably adjusting said length of said lockable telescopic device;

a first sleeve;

said first sleeve being disposed substantially concentric about said piston rod;

a second sleeve;

said second sleeve being disposed substantially concentric about said first sleeve;

said second sleeve having an outer circumference;

said outer circumference of said second sleeve abutting said inner circumference of said cylindrical tube;

said first sleeve being rotatably connected with said piston rod;

said second sleeve being rotatably connected with said cylindrical tube to rotate with said cylindrical tube;

a substantial portion of said outer circumference of said second sleeve making frictional contact with a substantial portion of said inner circumference of said cylindrical tube;

said frictional contact between said second sleeve and said cylindrical tube for providing a substantial locking force of said lockable telescopic device; and means for frictionally engaging said substantial portion of said outer circumference of said second sleeve with said substantial portion of said inner circumference of said cylindrical tube to axially lock said cylindrical tube and said piston rod with respect to one another.

2. The lockable telescopic device according to claim 1, further comprising:

said second sleeve being radially expandable;

said means for frictionally engaging comprises means for radially expanding said second sleeve;

said radial expansion of said second sleeve providing said frictional contact between said outer circumference of said second sleeve and said inner circumference of said cylindrical tube;

said frictional contact between said second sleeve and said cylindrical tube providing said substantial locking force of said lockable telescopic device.

3. The lockable telescopic device according to claim 2, wherein:

at least a portion of said second sleeve comprises a slot;

said slot of said second sleeve permitting said second sleeve to be radially expandable.

4. The lockable telescopic device according to claim 3, wherein:

said second sleeve comprises at least one portion having a substantially circular shape; and said at least one substantially circular portion of said second sleeve comprises a surface being disposed adjacent to said substantial portion of said inner circumference of said cylindrical tube;

said at least one substantially circular portion of said second sleeve is in frictional contact with said inner circumference of said cylindrical tube; and said frictional contact between said second sleeve and said cylindrical tube providing said substantial locking force of said lockable telescopic device.

5. The lockable telescopic device according to claim 4, wherein said at least one substantially circular portion of said second sleeve is adjacent to substantially all of said inner circumference of said cylindrical tube.

6. The lockable telescopic device according to claim 5, wherein:

said first sleeve comprises at least one portion having a substantially circular shape; and each said first sleeve and said second sleeve is in an axially fixed position on said piston rod.

7. The lockable telescopic device according to claim 6, further comprising means for preventing rotation of said second sleeve with respect to said cylindrical tube to rotatably connect said second sleeve with said cylindrical tube;

said means for preventing rotation of said second sleeve with respect to said cylindrical tube comprises:

a first keyway disposed on one of:

said second sleeve, and said cylindrical tube;

a first key corresponding to said first keyway, said first key being disposed on the other of:

said second sleeve, and said cylindrical tube.

8. The lockable telescopic device according to claim 7, wherein:

said first keyway is disposed on said inner circumference of said cylindrical tube;

said cylindrical tube comprises a length;

said first keyway is disposed substantially along said length of said cylindrical tube;

said first key projecting from a portion of said outer circumference of said second sleeve;

said first key is disposed within its corresponding first keyway; and said first keyway of said inner circumference of said cylindrical tube and its corresponding key of said second sleeve permitting said second sleeve to be slidably movable along said inner circumference of said cylindrical tube.

9. The lockable telescopic device according to claim 8, wherein:

said inner circumference of said second sleeve comprises at least one arc-shaped segment;

said outer circumference of said first sleeve comprises at least one arc-shaped segment;

said at least one arc-shaped segment of said first and second sleeves being disposed eccentric to said longitudinal axis of said piston rod;

said at least one arc-shaped segment of said inner circumference of said second sleeve being disposed adjacent and substantially concentric with said at least one arc-shaped segment of said first sleeve;

said at least one arc-shaped segment of said inner circumference of each of said first and second sleeves has a first end and a second end;

a substantial portion of each said at least one arc-shaped segment of said first and second sleeves is disposed between said first end and said second end of each said at least one arc-shaped segment;

said first end of each said at least one arc-shaped segment of said first and second sleeves has a radius with respect to said longitudinal axis;

said second end of each said at least one arc-shaped segment of said first and second sleeves has a radius with respect to said longitudinal axis;

said substantial portion of each said at least one arc-shaped segment of said first and second sleeves comprises a plurality of radii with respect to said longitudinal axis;

said first end of each said at least one arc-shaped segment of said first and second sleeves has a substantially greater radius than said radius of said second end of each said at least one arc-shaped segment of said first and second sleeves; and said substantial portion of each said arc-shaped segment of said second sleeve has a plurality of radii decreasing in length between said first end and said second end of each said at least one arc-shaped segment of said first and second sleeves.

10. The lockable telescopic device according to claim 9, wherein:

said means for rotating said piston rod in at least one direction;

said rotation of said means for rotating said piston rod in a first direction providing said substantial locking force of said lockable telescopic device;

said rotation of said means for rotating said piston rod in a second direction providing an unlocking of said lockable telescopic device.

11. The lockable telescopic device according to claim 10, wherein at least said second end of said at least one arc-shaped segment of said second sleeve at least partially comprises said at least one slot permitting said second sleeve to be radially expandable.

12. The lockable telescopic device according to claim 11, wherein:

each of said first and second sleeves comprises two said arc-shaped segments;

each said first end of each said arc-shaped segment of said first and second sleeves comprising said radius greater than said radius of each said second end of each said arc-shaped segment of said first and second sleeves;

said first end of said first arc-shaped segment of said second sleeve abuts said second end of said second arc-shaped segment of said second sleeve;

said second end of said first arc-shaped segment of said second sleeve abuts said first end of said second arc-shaped segment of said second sleeve;

said first end of said first arc-shaped segment of said first sleeve abuts said second end of said second arc-shaped segment of said first sleeve;

said second end of said first arc-shaped segment of said first sleeve abuts said first end of said second arc-shaped segment of said first sleeve;

said abutment of said first arc-shaped segment with said second arc-shaped segment providing said substantially circular shape of said at least one portion of said second sleeve;

said first end of said first arc-shaped segment radially extends inward and substantially beyond said second end of said second arc-shaped segment of said second sleeve;

said first end of said second arc-shaped segment radially extends inward and substantially beyond said second end of said first arc-shaped segment of said second sleeve; and each said extended radius of each said first end providing a substantially projecting portion adjacent each said first end of each said arc-shaped segment of said second sleeve.

13. The lockable telescopic device according to claim 12, wherein:

said second end of said piston rod comprises a shoulder;

said shoulder of said piston rod has an outer circumference;

said first sleeve has an inner circumference and an outer circumference;

said inner circumference of said first sleeve being disposed concentrically with and abutting said outer circumference of said shoulder of said piston rod; and said first sleeve being axially movable with said shoulder of said piston rod.

14. The lockable telescopic device according to claim 13 further comprising means for preventing rotation of said first sleeve with respect to said piston rod to rotatably connect said first sleeve to said piston rod.

15. The lockable telescopic device according to claim 14, wherein:

said means for preventing rotation of said first sleeve with respect to said piston rod comprises a second keyway;

said means for preventing rotation of said first sleeve with respect to said piston rod further comprises a second key corresponding to said second keyway;

said second keyway being disposed on said outer circumference of said shoulder of said piston rod;

said second key projecting from a portion of said inner circumference of said first sleeve;

said second key of said first sleeve being disposed within its corresponding second keyway of said shoulder of said piston rod; and said second keyway of said piston rod shoulder and its corresponding key of said first sleeve permitting said first sleeve to be axially movable with said shoulder of said piston rod.

16. The lockable telescopic device according to claim 15, further comprising:

means for providing fluid;

means for connecting said lockable telescopic device to said means for providing fluid;

said means for providing fluid between said cylinder tube and said piston rod;

said means for providing fluid to permit adjustment of said length of said lockable telescopic device;

said adjustable length for positioning said lockable telescopic device between said at least one movable object and said at least one other object.

17. A device for positioning at least one movable object relative to at least one other object, said device comprising:

a first tubular member, said first tubular member having an inner surface, and said first tubular member defines a longitudinal axis and first and second directions substantially parallel to said longitudinal axis, said second direction being substantially opposite to said first direction;

first attachment means for attaching said first tubular member to one of:
the at least one movable object, and
the at least one other object;

a second member, said second member comprising at least a portion slidably disposed within said first tubular member;

second attachment means for attaching said second member to the other of:
the at least one movable object, and
the at least one other object;

at least one of said first tubular member, and said second member, being moveable in said first and second directions with respect to the other of said first tubular member and said second member to move the at least one movable object with respect to the at least one other object; and means for locking said first tubular member and said second member in an axially fixed position with respect to one another to fixedly position the at least one movable object and the at least one other object with respect to one another, said means for locking comprising:

at least one sleeve disposed about said at least a portion of said second member disposed within said first tubular member, means for axially fixing said at least one sleeve with respect to said at least a portion of said second member for movement along with said second member;

said at least one sleeve comprises an outer surface disposed towards said first tubular member, said outer surface of said at least one sleeve having an outer periphery, said outer periphery abutting an adjacent portion of said inner surface of said first tubular member;

a substantial portion of said outer periphery of said at least one sleeve is disposed for making frictional contact with a substantial portion of said inner surface of said adjacent area of said first tubular member; and means for frictionally engaging said substantial portion of said at least one sleeve with said substantial portion of said inner surface of said adjacent area of said first tubular member to axially lock said first tubular member and said second member with respect to one another.

18. The device for positioning according to claim 17 wherein:

said at least one sleeve is radially outwardly expandable;

said means for frictionally engaging comprises means for radially expanding said at least one sleeve to press said substantial portion of said at least one sleeve into frictional engagement with said substantial portion of said inner surface of said adjacent area of said first tubular member; and said second member comprises said means for radially expanding said at least one sleeve.

19. The device for positioning according to claim 18 wherein:

said at least a portion of said second member comprises an outer surface;

at least a part of said outer surface of said at least a portion of said second member is eccentric to said longitudinal axis of said first tubular member;

said at least one sleeve comprises an inner surface disposed about said at least a part of said outer surface of said at least a portion of said second member;

said inner surface of said at least one sleeve having a contour substantially corresponding to said outer surface of said at least a portion of said second member;

said at least a portion of said second member being rotatable within said at least one sleeve to rotate said eccentic surface of said at least a part of said outer surface of said at least a portion of said second member against said inner surface of said at least one sleeve to radially outwardly expand said at least one sleeve.

20. The device for positioning according to claim 19 wherein:

said means for rotating said piston rod in at least one direction;

said rotation of said means for rotating said piston rod in a first direction providing said substantial locking force of said lockable telescopic device;

said rotation of said means for rotating said piston rod in a second direction providing an unlocking of said lockable telescopic device.

* * * * *

UNITED STATES PATENT AND TRADEMARK OFFICE

CERTIFICATE OF CORRECTION

PATENT NO. : 5,513,554

DATED : May 7, 1996

INVENTOR(S) : Roger PAULSSON

It is certified that error appears in the above-indentified patent and that said Letters Patent is hereby corrected as shown below:

In column 1, line 45, after 'IV-IV' insert --in--.

In column 1, line 47, before 'device', delete "invention" and insert --inventive--.

In column 4, line 56, after 'Dec.', delete "7," and insert --27,--.

In column 4, line 57, before 'on', delete "Trading/AB" and insert --Trading AB--.

Signed and Sealed this

Twenty-seventh Day of May, 1997

*Attest:*

Bruce Lehman

BRUCE LEHMAN

*Attesting Officer*

*Commissioner of Patents and Trademarks*